US006910607B2

(12) United States Patent
Gaiser et al.

(10) Patent No.: US 6,910,607 B2
(45) Date of Patent: Jun. 28, 2005

(54) COVER FOR DISPENSING CLOSURE WITH PRESSURE ACTUATED VALVE

(75) Inventors: Ricky G. Gaiser, Spring Grove, IL (US); Valentin Hierzer, Arlington Heights, IL (US); Robert Simpson, Grays Lake, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 123 days.

(21) Appl. No.: 10/098,819

(22) Filed: Mar. 15, 2002

(65) Prior Publication Data

US 2003/0173379 A1 Sep. 18, 2003

(51) Int. Cl.[7] ..... B65D 51/00

(52) U.S. Cl. ..... 222/490; 222/212; 222/494; 222/556; 222/562

(58) Field of Search ..... 222/212, 490, 222/494, 556, 562

(56) References Cited

U.S. PATENT DOCUMENTS

| | | | | | |
|---|---|---|---|---|---|
| 1,989,714 | A | | 2/1935 | Statham | 221/60 |
| 2,684,789 | A | | 7/1954 | Marchant | 222/212 |
| 2,713,953 | A | | 7/1955 | Jewell | 215/74 |
| 3,856,170 | A | | 12/1974 | Kessler | 215/224 |
| 4,728,006 | A | | 3/1988 | Drobish et al. | 222/181 |
| 4,749,108 | A | | 6/1988 | Dornsbusch et al. | 222/212 |
| 5,025,942 | A | | 6/1991 | Lucas | 215/318 |
| 5,115,950 | A | * | 5/1992 | Rohr | 222/212 |
| 5,213,236 | A | | 5/1993 | Brown et al. | 222/185 |
| 5,271,531 | A | | 12/1993 | Rohr et al. | 222/212 |
| 5,377,877 | A | | 1/1995 | Brown et al. | 222/105 |
| 5,390,805 | A | * | 2/1995 | Bilani et al. | 222/490 |
| 5,409,144 | A | | 4/1995 | Brown | 222/185 |
| 5,456,374 | A | | 10/1995 | Beck | 215/251 |
| 5,531,363 | A | | 7/1996 | Gross et al. | 222/494 |
| 5,632,420 | A | * | 5/1997 | Lohrman et al. | 222/212 |
| 5,642,824 | A | | 7/1997 | Hess, III et al. | 215/235 |
| 5,743,443 | A | | 4/1998 | Hins | 222/490 |
| 5,897,033 | A | * | 4/1999 | Okawa et al. | 222/212 |
| 5,927,549 | A | * | 7/1999 | Wood | 222/494 |
| 5,927,566 | A | * | 7/1999 | Mueller | 222/494 |
| 5,954,237 | A | * | 9/1999 | Lampe et al. | 222/494 |
| 5,971,232 | A | * | 10/1999 | Rohr et al. | 222/494 |
| 6,039,224 | A | * | 3/2000 | Dallas et al. | 222/556 |
| 6,089,411 | A | * | 7/2000 | Baudin et al. | 222/212 |
| 6,089,418 | A | | 7/2000 | Gaiser et al. | 222/490 |
| 6,112,951 | A | * | 9/2000 | Mueller | 222/494 |
| 6,179,166 | B1 | * | 1/2001 | Dallas et al. | 222/212 |

FOREIGN PATENT DOCUMENTS

| | | |
|---|---|---|
| EP | 0 555 623 A1 | 8/1993 |
| JP | 8-282703 | 10/1996 |

* cited by examiner

*Primary Examiner*—Kenneth Bomberg
(74) *Attorney, Agent, or Firm*—Woodcock Washburn LLP

(57) ABSTRACT

A cover for a valved dispensing closure prevents the valve from opening while the cover is disposed on closure. The cover's central projection prevents flaps formed in the valve from opening, and the cover's outer projection prevents the flexible valve head from moving or inverting. The cover may also have projections that project inwardly from its skirt. The cover projections interact with mating projections formed on an exterior of the closure, and a lower end of the skirt may be disposed into an annular groove in the closure, to enhance a seal between the closure and the cover.

27 Claims, 4 Drawing Sheets

COVER FOR DISPENSING CLOSURE WITH PRESSURE ACTUATED VALVE

FIELD OF THE INVENTION

This invention relates to closures for containers, and more specifically to dispensing closures having pressure activated valves and corresponding covers.

BACKGROUND OF THE INVENTION

A flexible dispensing valve system may be part of a package that is suitable for storing, shipping, and dispensing both high and low viscosity materials. Such high viscosity materials include shampoos, conditioners, soaps, and other flowable products such as other liquids, pastes and the like. Low viscosity materials include water, other beverages, and the like. The dispensing system, upon being inverted and/or squeezed, opens a self-sealing dispensing valve in the closure at a predetermined threshold pressure to discharge the contents of the corresponding container. Upon removal of the external forces and upon the container internal pressure being reduced below a predetermined threshold pressure for dispensing, the valve closes.

Self-sealing dispensing valves have been disclosed in U.S. Pat. Nos. 4,728,006; 5,271,531; and 5,531,363. Self-sealing dispensing valves are also offered commercially by Liquid Molding Systems, Inc. of Midland, Mich., which has been issued U.S. Pat. Nos. 5,213,236; 5,377,877 and 5,409,144. Each of these six patents is incorporated herein in their entireties.

Dispensing closures are, in most instances, required to render the packages suitable for shipping such that product will not inadvertently or accidentally be dispensed between the time the container is filled with product to be dispensed to the ultimate purchasers and use by a consumer. U.S. Pat. No. 6,089,418, which is incorporated herein by reference in its entirety, discloses a flexible valve sealing system having a protective cover. It is a goal to provide an improved flexible valve system and corresponding cover.

SUMMARY OF THE INVENTION

A closure for dispensing a product from a container includes a cover for a flexible dispensing valve. The cover, which is removably coupled to a base of the closure, includes a central post that extends downwardly from a top portion of the cover. A distal portion of the post contacts the flaps of the dispensing valve to inhibit the flaps from opening. The dispensing valve flaps are part of a valve head that open in response to internal positive pressure within the container from their at-rest, closed position. Thus, the post of the cover preferably contacts the flaps at the point of intersection of the slits forming the flaps. Further, an outer circular projection extending downwardly from the top portion may also restrict movement of the valve head. The projection preferably is a ring.

The cover prevents inadvertent opening of the valve

DETAILED DESCRIPTION

Figure 6:
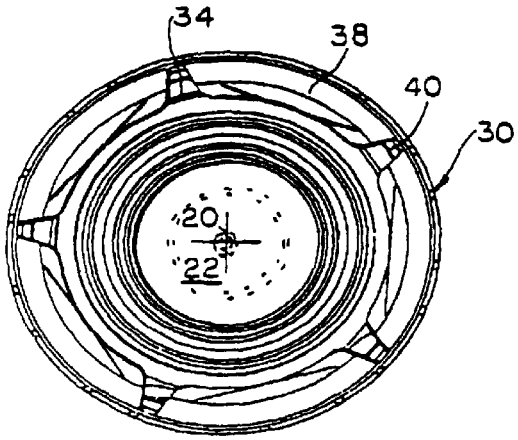
FIG. 6 is a bottom plan view of the dispensing package of FIG. 2.
Figure 7:
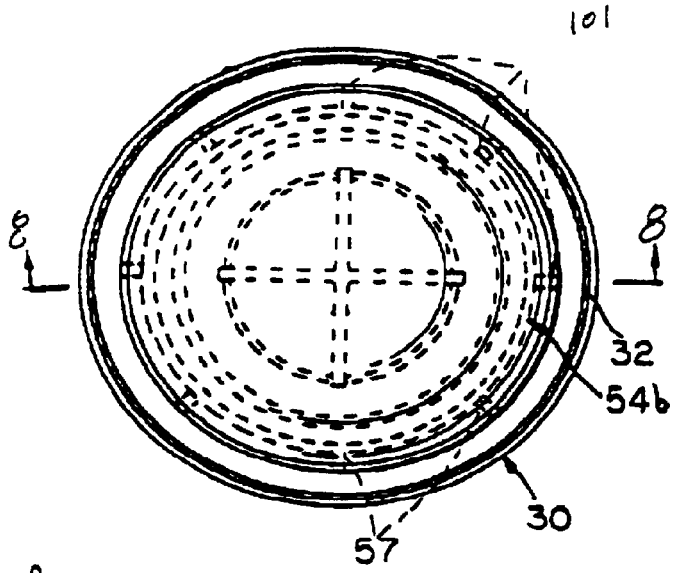
FIG. 7 PRIOR ART
FIG. 7 (PRIOR ART) is a top plan view of a prior art closure having a cross-shaped projection, which is shown in phantom.
Figure 8:
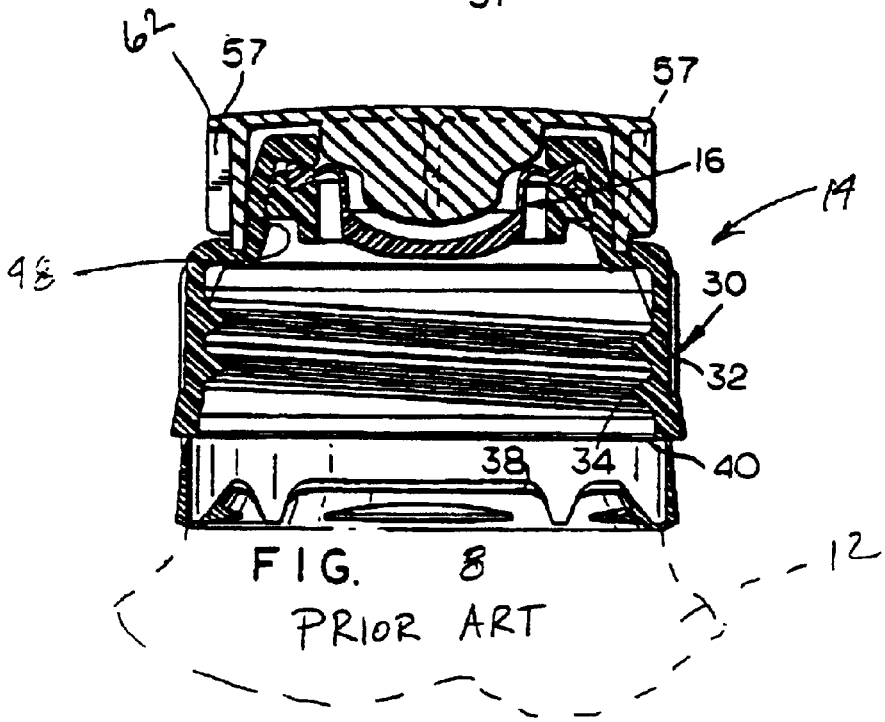
FIG. 8 PRIOR ART
FIG. 8 (PRIOR ART) is a cross sectional view of the closure shown in FIG. 7.

As shown in FIGS. 7 and 8, a conventional dispensing package includes a container 12 (shown schematically in FIGS. 7 and 8), a valved dispensing closure 14, and a cover 101, each of which is more fully described in U.S. Pat. No. 6,089,418, which is assigned to the present assignee The description FIGS. 7 and 8 employs reference numerals not shown in FIGS. 7 and 8, but which generally refer to analogous structure as shown in other figures and described in other portions of specification. The valved dispensing closure 14 includes a self-sealing dispensing valve 16, a base 30, and a retaining ring 50, as shown in FIGS. 7 and 8, and in the lower portion of FIG. 2. Valve 16 comprises a one-piece, integrally-molded member preferably constructed from liquid silicone rubber, or the like. Valve 16 includes a concave valve head 18 with cross-slits 20 defining pie shaped flaps 22 and a discharge orifice therein. Cross-slits 20 and flaps 22 are best shown in FIG. 6.

A connector sleeve 24 has one end connected with the marginal circumferentially extending flange 26, which is substantially triangular in cross section, and the opposite end connected with valve head 18 adjacent to this marginal edge. Connector sleeve 24 is resiliently flexible such that when pressure within bottle 12 is raised above a predetermined threshold value, connector sleeve is capable of deforming outwardly, as described more fully below. The valve head 18 has a circular plan shape, and a generally tapered thickness which is thicker at the radially outside portion of valve head 18 and thinner at the radially inside portion thereof. For further details of a self-sealing dispensing valve and the functioning of its parts usable with this invention, reference is made to U.S. Pat. Nos. 5,213,236, 5,377,877 and 5,409,144 which are incorporated herein by reference in their entireties.

Figure 1:
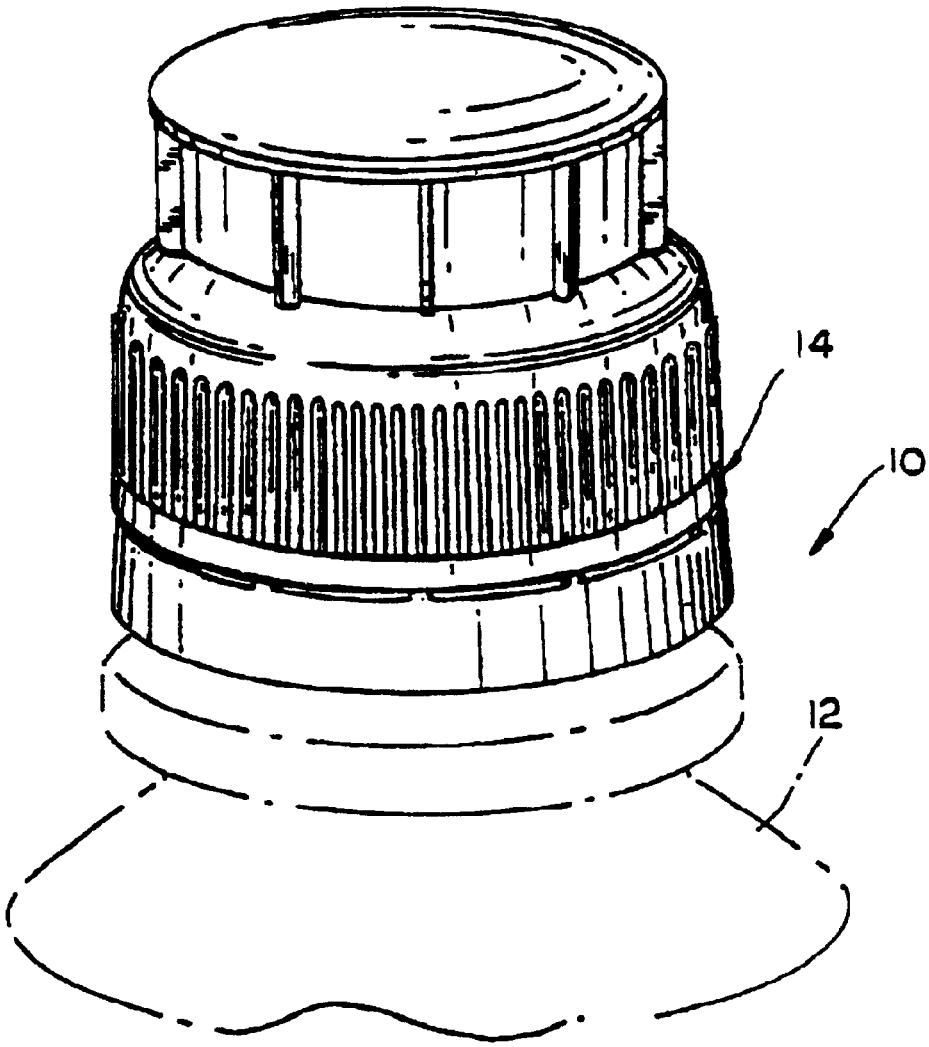
FIG. 1 is a front perspective view of a dispensing package showing the cover installed on the dispensing closure.
Figure 2:
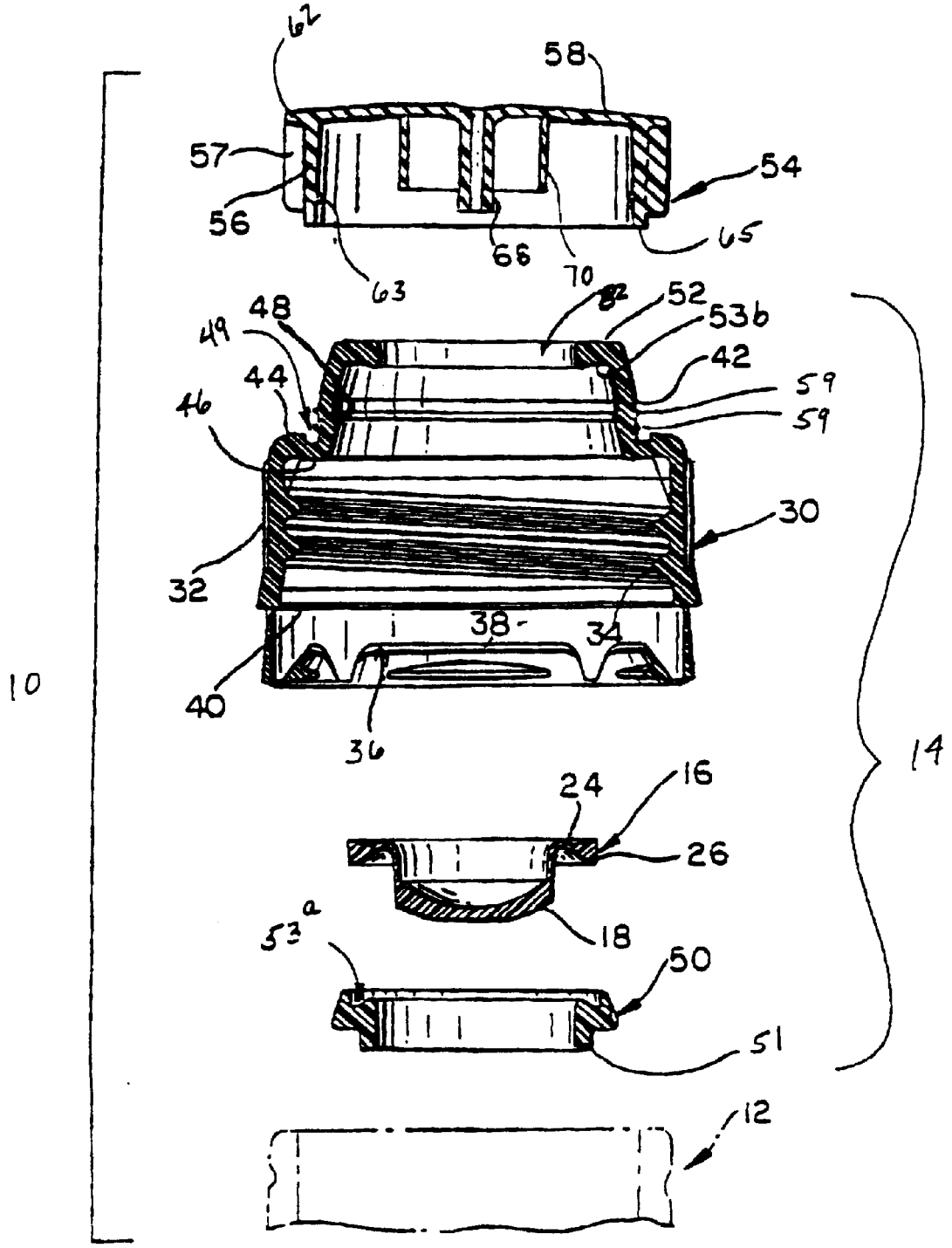
FIG. 2 is an exploded view of the dispensing closure and cover of FIG. 1 illustrating an aspect of the present invention.
Figure 3:
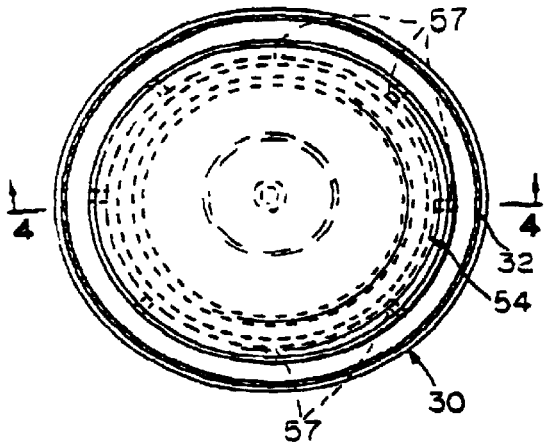
FIG. 3 is a top plan view of the closure and cover of FIG. 2.

Upon squeezing the sidewalls of container 12 such that bottle internal pressure is raised above a predetermined threshold value, connector sleeve 24 extends outwardly and valve head 18 shifts outwardly (that is, upward with respect to FIGS. 2 and 8). Flaps 22 open and unfold outwardly with a snapping action to permit product to be dispensed therethrough. The snap-type opening of valve 16 is believed to be achieved in part by the torque exerted on valve head 18 by the connector sleeve 24.

Upon negative pressure conditions on the interior side of the valve 16, such as that which results in response to release of bottle 12 after squeezing, the connector sleeve 24 and valve head 18 will return to their at-rest position with a torque snap action. During the return process, air is sucked through cross-slits 20 into the interior of bottle 12 until the negative pressure therein is substantially equalized. As the pressure differential across opposing sides of the valve 16 diminishes to near zero, flaps 22 reform to their at-rest, securely sealed configuration, and remain sealed even under the hydraulic head pressure applied thereto by the product upon inversion of bottle 12 (that is, opposite the orientation shown in FIGS. 2 and 8).

The cross shaped projection of the cover disclosed in the U.S. Pat. No. 6,089,418, under certain conditions, may sometimes provide an imperfect inhibition against deformation of flaps 22. For example, because the cover is installed, or replaced after an end user initially removes it, without regard for its angular position relative to the position of the flexible valve, the cross-shaped projections may be directly aligned with the slits, may be positioned equidistant from the slits (that is, halfway between each slit), or may be positioned such that an edge of the cross-shaped projections are disposed on or slightly spaced apart from the slits. The cover might not, depending on the magnitude of the internal pressure, temperature, resilience of the flaps, and like parameters, inhibit the valve from inadvertently opening while the cover is in each of the above positions, including both latter positions, (which may provide the smallest degree of inhibition from opening), and either of the two former positions.

The valved dispensing closure 14 may also include base 30, which includes a substantially cylindrical lower side wall 32 provided threads 34 for mating with corresponding threads (not shown) container 12. The bottom of the side wall 32 has a downwardly depending apron 36 having upwardly extending flanges 38 which are adapted to engage and lock under a radial rib (not shown) of the bottle neck when the closure 14 is initially applied to the neck of the bottle 12. The bottom of the side wall 32 is connected to the apron 36 through an interposed ruptureable line of weakening 40, thereby providing a tamper evident feature.

The base 30 preferably includes a reduced diameter upper side wall 42 connected to the lower side wall 32 by a substantially horizontal ledge 44. A circumferential sealing edge 46 may be formed on the underside of ledge 44 to engage the top of the neck of the bottle 12 for sealing therebetween. Sealing edge 46 preferably is sloped to form an angle of approximately five degrees from the horizontal so as to properly mate to a corresponding sealing surface on the lip of bottle 12. Thus, an inner rim of the sealing edge is lower than an outer portion of the sealing edge. Preferably, sealing edge 46 does not permanently deform when induction welded to the neck of the bottle, which improves over the "crab's claw" seal of other designs, which may occasionally deform, especially when induction welded to the bottle. Such deformation of the crab's claw design, which may be permanent, may promote leakage, especially upon re-use after initially removing base 30 from bottle 12.

The interior of the upper side wall 42 of base 30 includes a radially inwardly extending lip 48 and a substantially horizontal radially inwardly extending top 52. The base top 52 has an opening 82 for exposing the valve head 18 and connector sleeve 24 and for enabling the discharge of product from the valve 16. A circumferential extending recess 53*b* is formed on the underside of base top 52 substantially outside of opening 82.

Figure 4:
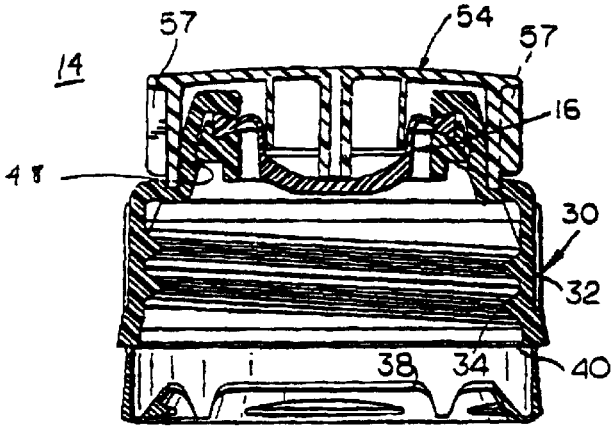
FIG. 4 is a longitudinal sectional view taken along line 4—4 in FIG. 3.
Figure 5:
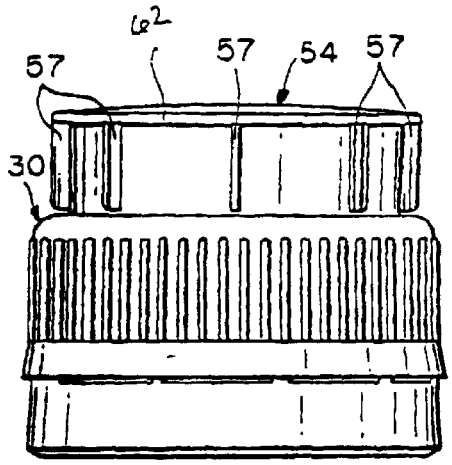
FIG. 5 is a side elevational view of the dispensing package of FIG. 1.

As shown in FIGS. 4 and 8, lip 48 is formed on the inner surface of base 30 below top 52. Lip 48 has an inner diameter that is smaller than an outer diameter of the lower rim of retaining ring 50. A sloped portion lip 48 provides a surface that contacts the lower rim of retaining ring 50, which is secured and anchored between the sloped portion of the lip 48 and the lower portion of flange 26. Lip 48, therefore, receives and anchors in place of the retaining ring 50.

The retaining ring 50 includes a circumferentially extending recess 53*a* on its upper face and a circular projection 51 that extends downward from an inner portion of retaining ring 50. Projection 51 stiffens retaining ring and facilitates assembly by providing a datum surface that may be gripped or used to manipulate ring 50 into position within base 30.

Preferably, the recess 53*a* in the retaining ring and the recess 53*b* in the base are opposing to form a triangular cross sectional shape to correspond to the cross sectional shape of flange 26. The triangular shapes of flange 26 and the corresponding recesses 53*a* and 53*b* provide a clamping action while the valve 16 is actuated. The provision for clamping valve flange 26 internally within the base top 52 by the internally secured retaining ring 50 is an important security and anti-tamper provision of the present invention.

The bottle 12 is preferably resiliently deformable and may be conveniently blow molded from one of many well known resins such as poly-propylene, polyethylene, polyvinyl, polyethylene terephthalate (PET) or the like. Bottle 12 preferably exhibits a sufficient degree of flexibility to permit manual deformation by squeezing of the bottle side walls to extrude product through the valve dispensing closure 14. The bottle 12 preferably also exhibits a sufficiently strong bias or pre-disposition to return to its undeformed condition when external forces are removed so that a substantial, virtually instantaneous pressure drop will be generated within the bottle, thereby assisting the seal of the valved dispensing closure 14 in a manner to be described in detail.

Cover 54 extends around the upper side wall 42 and over the top 52 of base 30 and valve 16, thereby protecting the closure 14. Cover 54 includes a downwardly depending substantially cylindrical skirt 56 that is adapted to slide tightly over and embrace the exterior of the upper side wall 42. Cover 54 also includes a top 58 that is formed at the upper end of skirt 56. A lip 62 is formed at the peripheral edge of the top 58, which provides a gripping surface for a user to remove the cover from base 30.

Radial fins 57 are provided on the exterior of skirt 56 to eliminate interlock with the tamper evident band of other similar closure. In this regard, fins 57 are oriented longitudinally on the cylindrical exterior of skirt 56 and yield into lip 62. Fins 57 prevent cover 54 (especially lip 62) from interlocking or interfering with gaps formed in tamper evident bands of other closures when they are randomly loaded into a storage container and when introduced into closure assembly equipment. Further, fins 57 stiffen cover 54 around skirt 56. As will be understood by persons familiar with closure configuration and design, the present invention encompasses members that protrude from cover 54 having shapes other than longitudinally extending fins, including (for example) one or more circumferential flanges, spiral or helical fins, pin fins, and the like, as well as covers that lack such protrusions.

Base 30 may include features that cooperate with the cover 54 to provide a water tight seal. In this regard, base 30 includes a pair of circumferential ribs 59*a* and 59*b* disposed around the exterior of the lower portion of the upper sidewall 42. Also, a circumferential recess 49 is formed in base 30 on ledge 44 at the base of upper sidewall 42. The present is not limited to covers and/or bases 30 that include ribs 59*a* and 59*b* and/or recess 49. Further, the present invention encompasses covers that have shapes other than a cylindrical skirt and substantially flat top, including conical and curved sidewalls.

When the user desires to dispense and use product from the bottle 12, the user removes the protective cover 54 by urging upward against lip 62. The bottle 12 is inverted and the product contained within the bottle 12 may be dispensed by squeezing the bottle side walls to increase the internal pressure of the container until it exceeds a threshold value to effect shifting of the valve head 18 from an inwardly concave sealed position. Specifically, the increase in internal pressure urges outward against valve head 18, which causes connector sleeve 24 to roll outward. Until connector sleeve 24 rolls outward, the concave surface of valve head 18 remains concave and undergoes little deformation, and the slits 22 remain closed When sleeve 24 rolls to its fully extended position, valve head 18 deforms such that flaps 22 open at slits 20 in response to a further increase in internal pressure of the bottle 12. Preferably, flaps 22 snap open.

Upon release of the bottle sidewalls, the squeezing forces are released and the internal pressures are reduced. In response to the diminished internal bottle pressures, the valve head 18 returns toward its at-rest, inwardly curved, concave position. Preferably, the flaps 22 snap shut in response to the decrease in internal pressure, thereby shutting off flow of the product. During the return process (that is, the return of valve 16 to its at-rest, sealed position) there is a momentary inward opening of the valve head 18, which enables venting of the bottle interior such that negative pressure within bottle 12 may be eliminated or reduced. Thus, valve 16 quickly returns to its at-rest, sealed leak-proof position and the dispensing package can remain in its inverted position without fear or concern over leakage of product.

Referring to FIGS. 2, 3, 4, and 5, cover 54 of the present invention may be assembled onto base 30 such that a lower-most circular edge 65 is insertable into recess 49. The full insertion of cover 54 into recess 49 corresponds to cover rib 63 being disposed between ribs 59*a* and 59*b*. A water tight seal may be formed by the engagement of ribs 59*a* and 59*b* with the exterior of skirt 56 of cover 54, and the engagement of rib 63 with the exterior surface of upper sidewall 42. Also, a water tight seal is formed by the engagement of edge 65 with recess 49. Ribs 59*a* and 63 provide a snap that secures cover 54 onto base 30, and its snapping or clicking together may provide an indication of positive sealing upon re-attaching the cover to the base by a user.

After a user has removed cover 54 from base 30, the user may lightly replace cover 54 without fully snapping cover rib 63 over base rib 59*a*. Specifically, cover 54 may be placed around a portion of upper sidewall 42, which is tapered. The inner diameter of the lower portion of cover 54 may be sized to contact the lower, outer portion of sidewall 42, and the contact may lightly hold cover 54 on base 30. This provides a beneficial configuration in circumstances in which it is desired to hold cover 54 in place or protect the valve 16 from dust even though a water tight seal is not important, such as, for example, in light re-use after initially removing the cover 54.

According to an aspect of the present invention, cover 54 has an inner projection 68 and an outer projection 70, each of which extends downwardly from the underside of top 58. Preferably, inner projection 68 includes a thin post (that is, thin compared to the overall diameter of cover 54) that projects downwardly from top 58 at a longitudinal centerline thereof. Outer projection 70 preferably is substantially concentric with inner projection 68, and preferably forms a cylinder that has a circular transverse cross section. Thus, an outboard surface of each of projections 68 and 70 form a circular cross section at their lower end. Preferably, inner projection 68 protrudes below outer projection 70 to correspond to the curvature of valve head 18.

Preferably, the distal end of inner projection 68 (that is, the end opposite top 58) is longitudinally disposed such that it lightly contacts the center or intersection of slits 20 and that it lightly contacts the tip of each of the flaps 22. Also, the distal tip of projection 70 is radially and longitudinally disposed such that it lightly contacts the curved portion of valve head 18 and such that it is radially spaced apart from slits 20. Outer projection 70 may also lightly contact connector sleeve 24, or projection 70 may contact connector sleeve 24 and be spaced apart from the concave portion of valve head 18.

As best shown in FIG. 4, projections 68 and 70 extend into the cavity formed by valve head 18 while cover 54 is fully seated into recess 49 (that is, while cover 54 is attached to base 30). With cover 54 fully seated into recess 49, the bottom tip of projection 68 contacts valve head 18 at its center at the intersection of the slits 20, and projection 70 lightly contacts the sidewall portion of the valve head 18 and/or connector sleeve 24. If the container is squeezed to increase its internal pressure while the cover 54 is fully inserted into recess 49, the outer projection 70 prevents the outer portion of valve head 18 from inverting or extending outwardly, and inner projection 68 prevents the pie-shaped flaps 22 from opening.

The present invention also encompasses projections 68 and 70 that are longitudinally spaced apart from valve head 18, and which contact valve head 18 upon partial outward extension. Thus, when referring to the projections 68 and/or 70 contacting valve head 18, the present invention encompasses any contact, including for example, light contact, contact that displaces flaps 22, and contact that occurs only upon outward movement of flaps 22 such that there is a gap formed between either or both projections 68 and 70 in the at-rest position. The projections 68 and 70 prevent inadvertent actuation of the valve head 18 by preventing flaps 22 from opening because their tips are prevented from opening by projection 68 and by preventing valve head 18 from shifting from its concave position because valve head 18 and/or connector sleeve 24 is held by projection 70.

The particular configuration of the projections provided herein illustrates an aspect of the present invention. The present invention is not, however, limited to the particular configurations described above. Rather, the present invention encompasses any configuration of projection that extends downwardly to restrict the opening of flaps 22, including, for example, for any configuration of projection 68, only a projection (such as projection 68) disposed at the longitudinal centerline of the closure (that is, without projection 70), and other configurations that will be apparent to persons familiar with closures and/or flexible dispensing valves. For example, the present invention encompasses projections that form a conical shape having a circular transverse cross section, projections that form an oval or other non-circular shape, and projections that are discontinuous as viewed in transverse cross section (such as, for example, several posts or arc-like sections that together make up either an inner projection or outer projection and perform the functions thereof as described herein). Further, the outer projection encompasses downwardly projecting pins, as distinguished from a circular projection, that contact valve head 18 and/or connector sleeve 24.

The present invention is not limited to the particular embodiment or configuration described herein, but, rather encompasses various modifications or variations, as will be understood by persons generally familiar with closure technology. For example, the present invention is not limited to any particular configuration of the valve, means of securing the cover to the valve, and the like. Thus, the scope of the invention is determined by the appended claims.

We claim:

1. A closure for dispensing a product from a container, the closure comprising:

a base fanning an orifice through which the product is capable of passing, the base including a coupling member extending inwardly toward the orifice for coupling the base to the container;

a flexible dispensing valve secured within the base, the dispensing valve including a valve bead having flaps formed therein that open from an at-rest, sealed position, the dispensing valve flaps being formed by slits formed in the valve head, the slits forming an intersection point thereof; and a cover removably coupled to the base, the cover including a central post extending downwardly from a top portion of the cover and an outer projection disposed concentrically about said central post, a distal portion of the post contacting the flaps at or proximate the intersection point to inhibit the flaps from opening.

2. The closure of claim 1 wherein the central post contacts the flaps at the intersection point.

3. The closure of claim 1 wherein the outer projection is a ring extending downwardly from the top portion of the cover, the ring restricting movement of the valve head to inhibit the valve bead from inverting.

4. The closure of claim 1 wherein the cover includes outwardly projecting fins for inhibiting interlock with tamper evident means on the base of other similar closures.

5. The closure of claim 1 wherein the dispensing valve includes a periphery that is fixed relative to the base and a connector sleeve coupled between the valve periphery and the valve head.

6. The closure of claim 5 wherein the outer projection inhibits the dispensing valve from opening.

7. The closure of claim 6 wherein the outer projection contacts the valve head to inhibit the valve head from inverting in response to container internal pressure.

8. The closure of claim 6 wherein the outer projection contacts the connector sleeve to inhibit the valve head from inverting in response to container internal pressure.

9. The closure of claim 1 wherein the cover includes a skirt downwardly depending from the top portion, the skirt removably contacting the base to removably secure the cover to the base.

10. The closure of claim 1 wherein a distal tip of the cover is disposed in an annular recess in the base.

11. The closure of claim 9 wherein the cover includes at least one circumferential cover bead extending inwardly from the skirt and the base includes at least one circumferential base bead extending outward from an exterior portion thereof, the cover bead and the base bead cooperating upon coupling of the cover and the base.

12. A valved dispensing closure for a neck of a deformable container for containing product to be dispensed by a dispensing operation through a discharge orifice in the closure in response to manually applied lateral squeezing forces on the container and for automatically ceasing the dispensing operation when manually applied forces are removed, the closure comprising:

a base having an interior, a coupling member capable of mating with the neck of the container, and a substantially horizontal radially inwardly extending top having a lower inner face and an opening, the base including a lower side wall and an upper side wall of reduced diameter and a substantially horizontal ledge interposed therebetween, the upper side wall having a lower end and the ledge having a circumferentially extending exterior recess at the lower end of the upper side wall, the base having an internal radially extending lip on the interior of the base adjacent to the top;

a self sealing dispensing valve extending across the opening of the top and having a periphery and a central valve bead having the discharge orifice which opens at a predetermined threshold pressure which is greater than a maximum hydraulic head pressure of the product in said container when the container is suspended in an inverted position with the discharge orifice facing downwardly, said valve head having a predetermined inwardly concave configuration while the valve is in an at rest, unstressed condition when the valved closure is mounted on the neck of the container and the container is in an undeformed condition, said valve head having at least one slit defining the discharge orifice extending through its thickness from its innermost surface to its outermost surface, said valve exhibiting an ability to undergo movement from a closed, inwardly concave, sealed and leak-resistant position to an open, outwardly convex, unsealed position when said manually applied lateral squeezing forces increase the pressure inside the container beyond the threshold opening pressure of said valve to open the slit and consequently the discharge orifice, whereby product is adapted to be discharged from the container through the discharge orifice as long as the manually applied squeezing forces on the container maintain an internal pressure exceeding the threshold opening pressure of the valve, said valve also exhibiting an ability to automatically cutoff the product discharge by returning to its closed inwardly concave, sealed and lea resistant position whenever the manually applied forces are removed from the container, the valve having a circumferentially extending flange located beneath the lower inner face of the base top;

an internal retaining ring disposed within the interior of the base and having an upper face, the retaining ring having a circumferential recess formed proximate the upper face, the flange secured between the retaining ring recess and an opposing recess formed on the lip to clamp the valve flange between the retaining ring and the lower inner face of the top; and a removable cover including a downwardly depending cylindrical skirt being removably disposed over the upper side wall, a cover top extends over the base top and is coupled to the skirt, and a central post extending downwardly from a center of the cover top and contacting the valve head to inhibit opening thereof.

13. The valved dispensing closure of claim 12 wherein the base ledge is provided with an internal circumferentially extending settling edge formed on an interior surface of the base for sealing the base to the neck of the container.

14. The valved dispensing closure of claim 12 wherein a lower end of the cylindrical skirt extends into the circumferentially extending recess in the ledge to define interengaging surfaces providing a watertight seal between the cover and closure base.

15. The valved dispensing closure of claim 12 wherein the closure top further includes an outer projection extending downwardly from the cover top and spaced apart from the post.

16. The valved dispensing disclosure of claim 15 wherein the outer projection is a cylinder.

17. The valved dispensing closure of claim 15 wherein the post contacts a center portion of the valve head to resist opening of the valve, and the outer projection substantially contacts the valve to resist inverting of the valve.

18. The valved dispensing closure of claim 17 wherein the outer projection contacts the valve head.

19. The valved dispensing closure of claim 17 wherein the outer projection substantially contacts an inner portion of a connector sleeve that is disposed between the valve head and the periphery of the valve.

20. The valved dispensing closure of claim 12 wherein the cylindrical skirt of the cover includes an inner face having a circumferentially extending, radially inwardly projecting rib having an upper edge, the upper side wall of the base including an outer face having a circumferentially extending radially outwardly projecting rib having a lower edge, the lower edge of the outwardly projecting rib of the base upper side wall and the upper edge of the outwardly projecting rib of the cover skirt inter-engaging when the cover is slid over the base upper side wall with the lower end of the cylindrical skirt of the cover extending into the circumferentially extending recess in the base ledge to enhance the watertight seal between the cover and the closure base.

21. The valved dispensing closure of claim 20 wherein the rib of the skirt contacts the outer face of the upper sidewall of the base and the rib of the base upper sidewall contacts the inner face of the skirt.

22. The valved dispensing closure of claim 12 wherein the valved head includes a pair of intersecting slits.

23. The valved dispensing closure of claim 12 wherein the self-sealing dispensing valve includes an integral connector sleeve interconnecting the valve head and flange of the valve.

24. The valved dispensing closure of claim 12 wherein the base includes a lower side wall and a tamper evident band is at the bottom of the lower side wall to visually indicate when the closure is removed from the neck of the container after having been fully applied to the neck following filling of the container with product to be dispensed.

25. The valved dispensing closure of claim 24 wherein the cover skirt has external radially outwardly projecting fins for inhibiting interlock with the tamper evident means on the base of other similar closures.

26. The valved dispensing closure of claim 25 wherein the sealing edge forms a slope such that an inner rim of the sealing edge as lower than an outer portion of the sealing edge.

27. The valved dispensing closure of claim 12 wherein the base includes a lower side wall having internal threads for mating with external threads on the neck of the container.

* * * * *